United States Patent [19]

Inaba et al.

[11] Patent Number: 5,007,850

[45] Date of Patent: Apr. 16, 1991

[54] CATHODE RAY TUBE SOCKET HAVING AN IMPROVED HIGH VOLTAGE DISCHARGE HOUSING

[75] Inventors: Hirofumi Inaba; Yasunori Nishikawa, both of Yao, Japan

[73] Assignee: Hosiden Electronics Co., Ltd., Osaka, Japan

[21] Appl. No.: 407,081

[22] Filed: Sep. 14, 1989

[30] Foreign Application Priority Data

Sep. 29, 1988 [JP] Japan ..... 63-128607
Sep. 29, 1988 [JP] Japan ..... 63-128608

[51] Int. Cl.[5] ..... H01R 13/53; H01J 29/00

[52] U.S. Cl. ..... 439/182; 313/51; 313/325; 313/477 HC; 313/318; 174/140 R

[58] Field of Search ..... 313/477 HC, 318, 313, 313/49, 51; 174/137 R, 138 R, 138 F, 140 R, 141 R, 148, 150; 439/602, 182

[56] References Cited

U.S. PATENT DOCUMENTS 4,266,158 5/1981 Uda et al. ..... 439/93
4,298,815 11/1981 Ishihara et al. ..... 313/325
4,573,755 3/1986 Simovits, Jr. ..... 439/607
4,649,315 3/1987 Inaba et al. ..... 313/51
4,822,301 4/1989 Inaba et al. ..... 439/436
4,960,385 10/1990 Kim ..... 439/890

*Primary Examiner*—Donald J. Yusko
*Assistant Examiner*—John E. Giust
*Attorney, Agent, or Firm*—Pollock, VandeSande and Priddy

[57] ABSTRACT

In a cathode ray tube socket which is provided with a socket body having a plurality of contacts disposed in a circle and a high voltage discharge gap housing provided on one side of the socket body, there are provided along the inside surface of both a case forming the high voltage discharge gap housing and a cover to be put on the case on the side of its open end face a plurality of plate-shaped ribs extending in a direction across a high voltage discharge in the high voltage discharge gap housing. The ribs of the case and the cover are disposed at predetermined intervals so that they do not overlap each other. A meandering ridge is formed along one of the opposed side walls of the case and cover to define a gap therebetween.

5 Claims, 4 Drawing Sheets

CATHODE RAY TUBE SOCKET HAVING AN IMPROVED HIGH VOLTAGE DISCHARGE HOUSING

BACKGROUND OF THE INVENTION

The present invention relates to a cathode ray tube socket which is provided with a socket body having a plurality of contacts disposed in a circle and a high voltage discharge gap housing formed on one side of the socket body.

In this kind of cathode ray tube socket a high voltage discharge gap housing is provided on one side of the socket body and the high voltage discharge gap housing comprises a case having housed therein discharge electrodes and a cover for covering the case as disclosed in U.S. Pat. No. 4,649,315 or 4,822,301, for instance. In order to increase the creeping distance between a high voltage electrode and a grounding electrode in the high voltage discharge gap to prevent the generation of an abnormal discharge along the interior surfaces of the case and the cover, there are provided on their inside surfaces ribs 13 and 14 as shown in FIGS. 1, 2 and 3 which are a vertical sectional view of a high voltage discharge gap housing 28 on the opposite side from the socket body, a vertical sectional view taken on the line II-II in FIG. 1 and a horizontal sectional view taken on the line III-III in FIG. 1, respectively. Conventionally, the ribs 14 of the cover 12 are each partially disposed between adjacent ribs 13 of the case 11. Where the spacing of each of the ribs 13 and 14 is small, discharge current does not flow along the wall surfaces of the case 11 and the cover 12 but instead it flows along a line joining the projecting ends of the ribs 13 and 14, skipping over grooves defined by them. For example, when the spacing g between the ribs 13 and 14 is 1 mm or more, the discharge current flows in zigzag along the inner surfaces of the cover 12 and the case 11 as indicated by the line 16 in FIGS. 2 and 3. When the spacing g is less than 1 mm, the discharge current flows straight as indicated by the line 17, and consequently, the creeping distance cannot essentially be maintained large. In other words, the prior art has a defect that miniaturization of the cathode ray tube socket reduces the creeping distance. Further, no measures have been taken against the discharge along the plane of contact between the case 11 and the cover 12.

SUMMARY OF THE INVENTION

It is therefore an object of the present invention to provide a cathode ray tube socket in which it is difficult for a discharge to occur along the surfaces of its case and cover.

According to the present invention, ribs are formed on the case and the cover of the high voltage discharge gap housing in such a manner that the ribs of the cover do not intersect the line joining the projecting ends of the ribs of the case.

Furthermore, a gap is defined between opposed wall surfaces of the cover and the case received therein and a zigzag ridge which is interposed therebetween is formed on one of the opposed wall surfaces.

DESCRIPTION OF THE PREFERRED EMBODIMENTS

Figure 4:
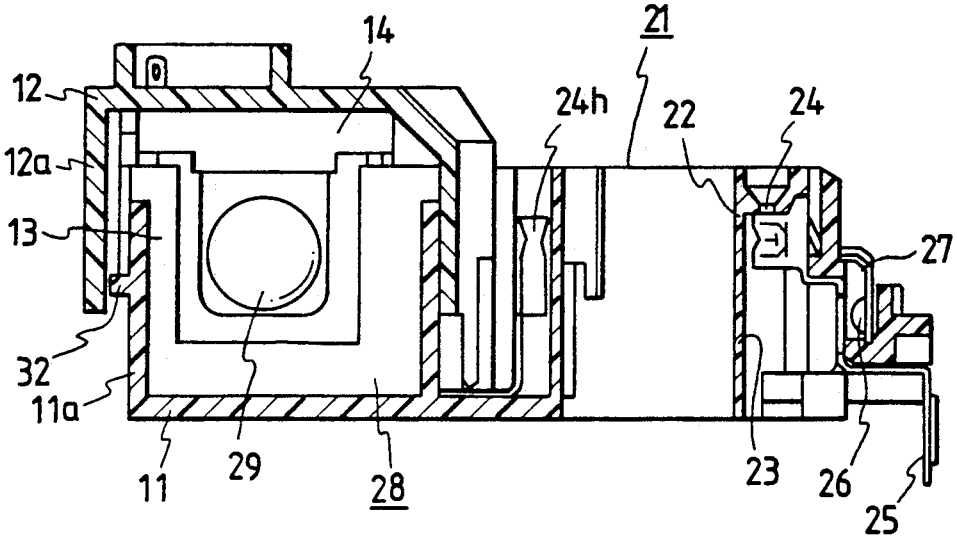
FIG. 4 is a vertical sectional view illustrating an embodiment of the present invention.

FIG. 4 is a longitudinal-sectional view of an embodiment of the present invention. A socket body 21 of a resin material is disc-shaped and has a centrally-disposed hole 22, around which there are provided a plurality of holes 23 for receiving contacts 24. A terminal 25 of each contact 24 is led out on the back of the socket body 21, and a ground ring 27, which forms a low voltage discharge gap 26, is fitted into the socket body 21 at a position corresponding to the intermediate portion of the terminal 25. One of the contacts 24 is used as a contact for high voltage (focusing) use (hereinafter referred to as a high voltage contact) **24*h*, and a high voltage discharge gap housing 28 is provided on the side of the socket body 21 next to the high voltage contact 24*h*. The high voltage discharge gap housing 28 comprises a case 11 which accommodates a high voltage discharge electrode 29 and a cover 12 which receives substantially the upper half portion of the case 11 on its open end face. The case 11 is formed as a unitary structure with the socket body 21**.

Figure 6:
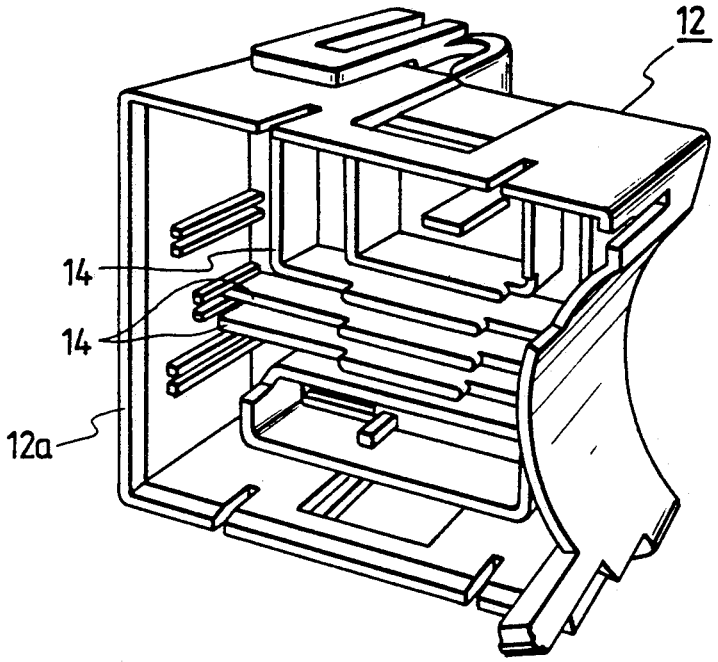
FIG. 6 is a perspective view of a cover 12 for use in the embodiment shown in FIG. 4.
Figure 5:
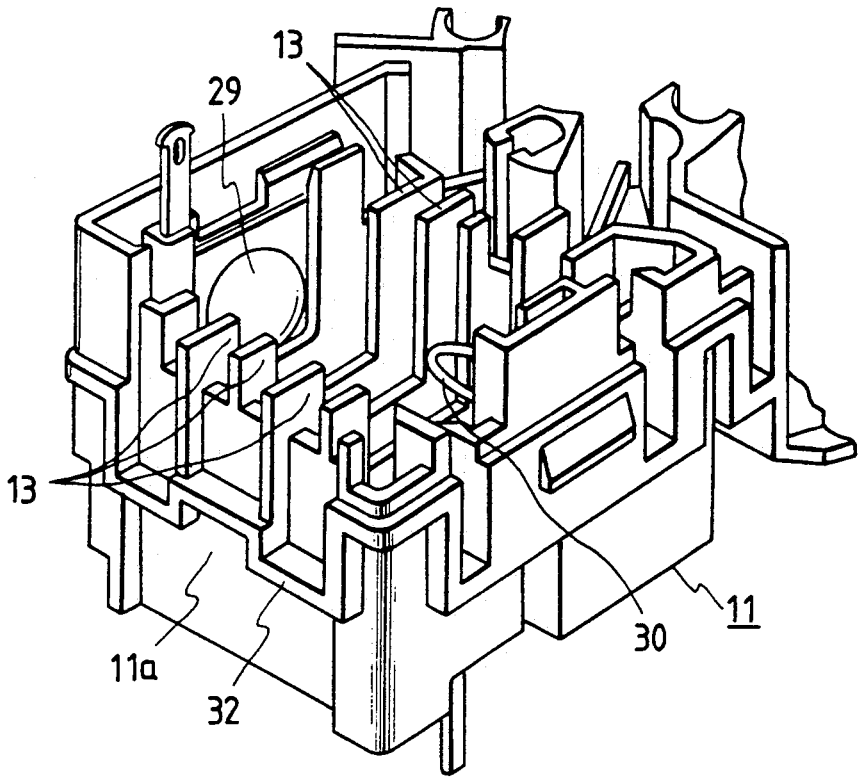
FIG. 5 is a perspective view of a case 11 for use in the embodiment shown in FIG. 4.

FIG. 5 is a perspective view of the case 11, in which the high voltage discharge electrode 29 having a semi-spherical portion and a U-shaped discharge electrode on the ground side 30 are disposed opposite to each other. On the inside of the case 11 there are protrusively provided plate-shaped ribs 13 which are spaced apart in parallel and extend in a direction across an expected high voltage discharge which would be produced between the discharge electrodes 29 and 30. FIG. 6 is a perspective view of the cover 12. On the inside of the cover 12 there are protrusively provided plate-shaped ribs 14 which extend in parallel with the ribs 13 when the cover 12 is mounted on the case 11.

Figure 1:
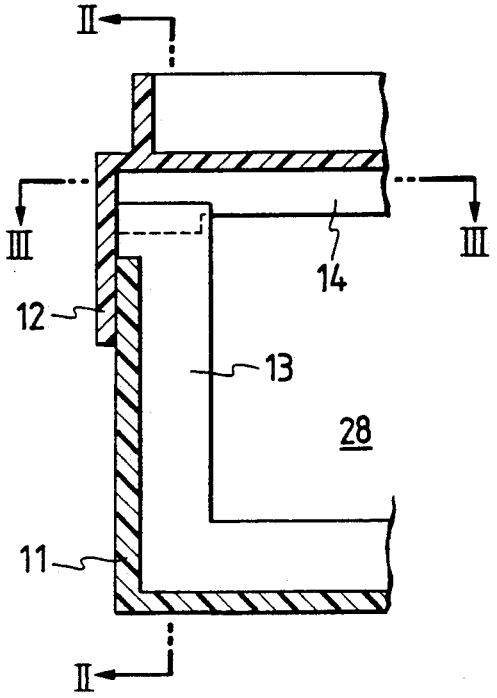
FIG. 1 PRIOR ART
FIG. 1 is a vertical sectional view of one side wall and its vicinity of a high voltage discharge gap housing of a conventional cathode ray tube socket.
Figure 2:
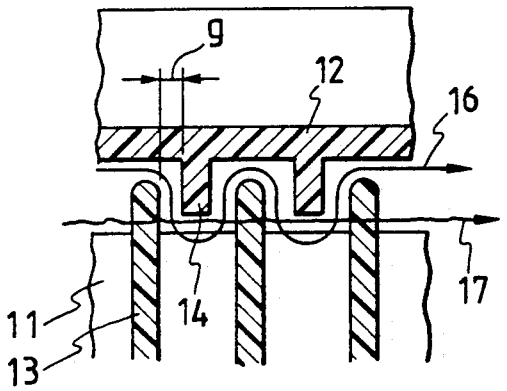
FIG. 2 PRIOR ART
FIG. 2 is a vertical sectional view taken on the line II-II in FIG. 1.
Figure 3:
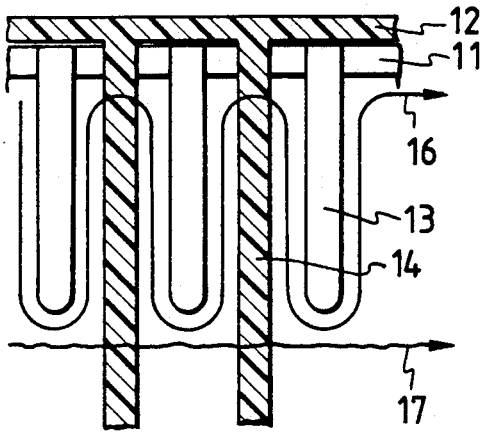
FIG. 3 PRIOR ART
FIG. 3 is a horizontal sectional view taken on the line III-III in FIG. 1.
Figure 7:
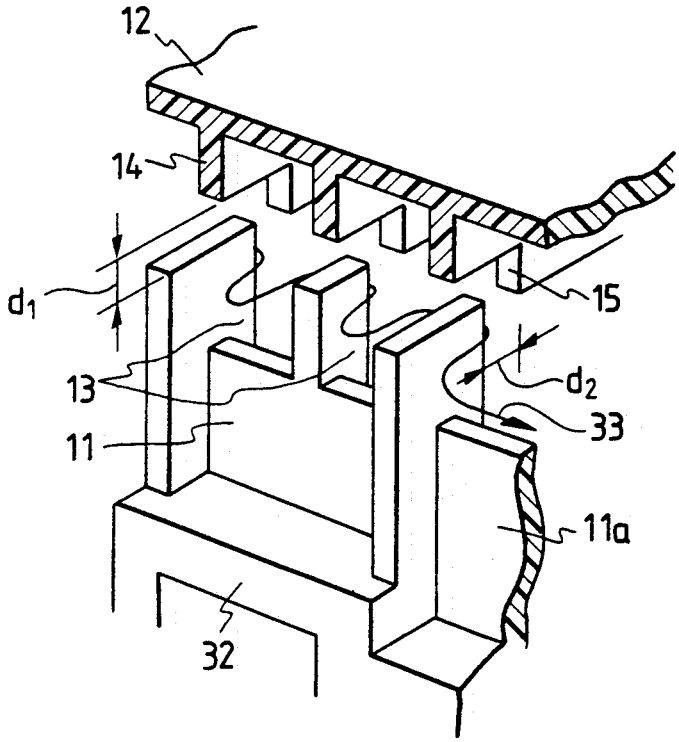
FIG. 7 is a perspective view for explaining the positional relationship between ribs 13 and 14 in the vicinity of the side wall of the high voltage discharge gap housing in the FIG. 4 embodiment.
Figure 8:
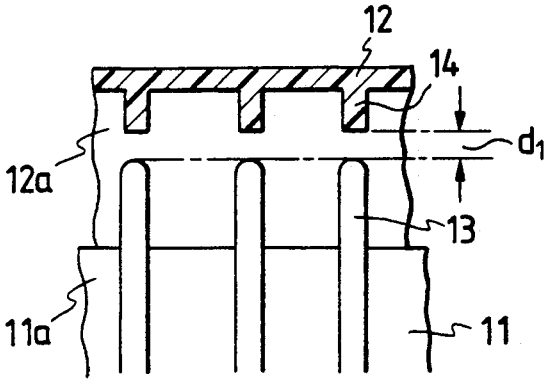
FIG. 8 is a vertical sectional view showing the positional relationship between the ribs 13 and 14 in FIG. 7.

Referring now to FIGS. 7 and 8, the positional relationship between the ribs 13 of the case 11 and the ribs 14 of the cover 12 will be described with respect to the portions of the ribs 13 and 14 provided on the rear side walls **11*a* and 12*a* of the case 11 and the cover 12. In FIG. 7, however, the side wall 12*a* of the case cover 12 is cut away so as to facilite a better understanding of the positional relationship of the ribs. The ribs 13 of the case 11 project out toward the cover 12 from the edge of the side wall 11*a* near the cover 12. The ribs 14 of the cover 12 are provided so that they are opposed to the projecting ends of the ribs 13 at a distance $d_1$ in the same plane. In this embodiment the central portion of each rib 14 extending along the interior surface of the cover 12 projects out toward the case 11 to form a stepped portion 15, the vertical surface of which is also opposed to the corresponding rib 13 at a distance $d_2$. That is, the ribs 14 of the cover 12 do not cross a plane which joins the array of end faces of the ribs 13 of the case 11 projecting toward the cover 12 or the plane that joins the array of their top faces perpendicular to the end faces. Since this structure eliminates such overlapping of the ribs 13 and 14 of the case 11 and the cover 12 as has been experienced in the past, the creeping distance along the line 33 acts effectively, preventing the aforementioned linear abnormal discharge which occurs along the end faces or top faces of the ribs 13 and 14 of the case 11 and the cover 12 as indicated by the line 17 in FIGS. 2 and 3**.

Figure 9:
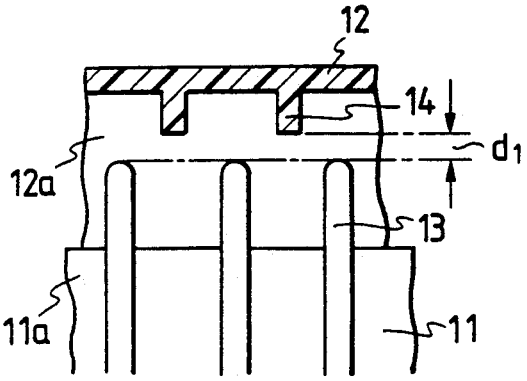
FIG. 9 is a vertical sectional view showing the positional relationship between the ribs 13 and 14 in another embodiment of the present invention.

While in FIGS. 7 and 8 the ribs 13 and 14 of the case 11 and the cover 12 are shown to be formed in alignment with each other, they may also be staggered as depicted in FIG. 9. In this case, the distances $d_1$ and $d_2$ ($d_2$ being not shown) between the ribs 13 and 14 are selected greater than in FIGS. 7 and 8.

Figure 10:
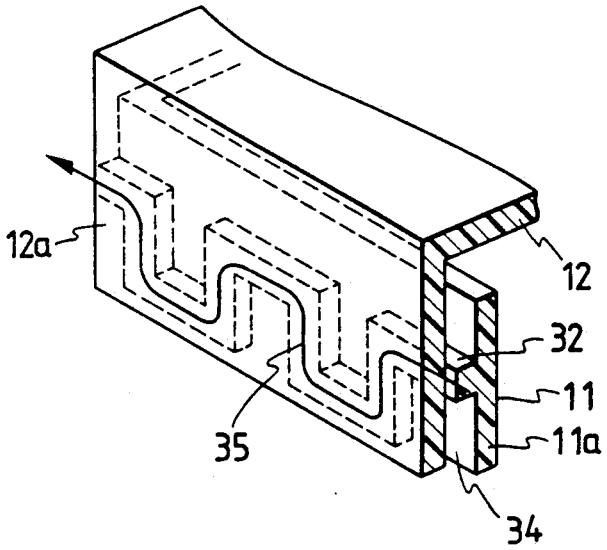
FIG. 10 is a partial perspective view illustrating another embodiment of the present invention.

FIG. 10 illustrates another embodiment of the present invention, showing only the side walls 11*a* and 12*a* of the case 11 and the cover 12 and the neighboring portions. In this embodiment a meandering ridge 32 is protrusively provided on the outside surface of the side wall 11*a* of the case 11. When the case 11 is received in the cover 12, the top face of the meandering ridge 32 abuts against the inner surface of the side wall 12*a* of the cover 12, defining a gap 34 between the side walls 11*a* and 12*a* of the case 11 and the cover 12. With such a structure, the creeping distance along the plane of contact between the side walls 11*a* and 12*a* of the case 11 and the cover 12 can be increased as indicated by the line 35, thereby preventing the generation of a discharge along the above-mentioned plane of contact. The meandering ridge 32 may also be extended to the outside surfaces of other side walls of the case 11 as depicted in FIG. 5. Alternatively, such a meandering ridge 32 may be provided on the interior surface of the side wall of the cover 12.

As described above, according to the present invention, when the case 11 is covered by the cover 12, the gaps $d_1$ and $d_2$ are defined between them so that their ribs 13 and 14 do not overlap, and consequently the creeping distance between the high voltage discharge electrode 29 and the ground electrode 30 can be maintained long as indicated by the curve 33. Further, the creeping distance along the plane of contact between the side walls 11*a* and 12*a* of the case 11 and the cover 12 can be increased by providing the meandering ridge 32 between them.

It will be apparent that many modifications and variations may be effected without departing from the scope of the novel concepts of the present invention.

What is claimed is:

1. A cathode ray tube socket which is provided with a socket body having a plurality of contacts disposed in a circle and a high voltage discharge gap housing provided on one side of said socket body, said high voltage discharge gap housing comprising a case formed as a unitary structure with said socket body and having an open end face, and a cover which overlies said opened face of said case;

said case having a plurality of plate-shaped first ribs formed on an inner wall surface of said case, said plurality of first ribs extending along said inner wall surface in a direction across a high voltage discharge in parallel and spaced-apart relation to one another; and said cover having a plurality of plate-shaped second rigs formed on an inner wall surface of said cover to extend therealong in a direction across the high voltage discharge, each of said second ribs being aligned with a corresponding one of said first ribs, end portions of each of said second ribs being located opposite to end portions of a corresponding one of said first ribs in a close but spaced-apart relation thereto.

2. The cathode ray tube socket of claim 1 wherein said first ribs are formed on the inside surfaces of side walls of said case opposing each other in lateral relation to said socket body and extending toward said cover.

3. The cathode ray tube socket of claim 2 wherein the central portion of each of said second ribs projects toward said case.

4. The cathode ray tube socket of claim 1 wherein one of the opposed side walls of said case and said cover has meandering ridge extending thereon to form therebetween a gap defined by said ridge.

5. A cathode ray tube socket which is provided with a socket body having a plurality of contacts disposed in a circle and a high voltage discharge gap housing provided on one side of said socket body, said high voltage discharge gap housing comprising a case formed as a unitary structure with said socket body and having an open end face, and a cover which overlies said open end face of said case, said cover and said case having opposing side walls;

said case having a plurality of plate-shaped first ribs formed on an inner wall surface of said case to extend therealong in a direction across a high voltage discharge in parallel and spaces-apart relation to one another;

said cover having a plurality of plate-shaped second ribs formed on an inner wall surface of said cover to extend therealong in a direction across the high voltage discharge; and one of the opposed side walls of said case and said cover having a meandering ridge extending therealong to form therebetween a gap defined by said ridge.

* * * * *